US006187528B1

(12) United States Patent
Uytterhoeven et al.

(10) Patent No.: US 6,187,528 B1
(45) **Date of Patent: *Feb. 13, 2001**

(54) PHOTOTHERMOGRAPHIC RECORDING MATERIAL COATABLE FROM AN ACQUEOUS MEDIUM

(75) Inventors: Herman Uytterhoeven, Bonheiden; Yvan Gilliams, Hever; Jan Gilleir, Mortsel, all of (BE)

(73) Assignee: Agfa-Gevaert, Mortsel (BE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/009,721

(22) Filed: Jan. 20, 1998

Related U.S. Application Data

(63) Continuation of application No. PCT/EP96/04356, filed on Jun. 13, 1996.

(30) Foreign Application Priority Data

Jul. 18, 1995 (EP) ..... 95201968

(51) Int. Cl.[7] ..... G03C 1/498

(52) U.S. Cl. ..... 430/619; 430/531; 430/620; 430/631; 430/637; 430/350

(58) Field of Search ..... 430/619, 350, 430/617, 631, 531, 637, 620

(56) References Cited

U.S. PATENT DOCUMENTS

| | | | | |
|---|---|---|---|---|
| 4,105,451 | * | 8/1978 | Smith et al. . | |
| 4,120,728 | * | 10/1978 | Ikenoue et al. . | |
| 4,157,289 | * | 6/1979 | Ikenoue et al. . | |
| 4,504,575 | * | 3/1985 | Lee | 430/531 |
| 5,747,412 | * | 5/1998 | Leenders et al. | 503/201 |
| 5,876,915 | * | 3/1999 | Deroover et al. | 430/619 |

* cited by examiner

*Primary Examiner*—Thorl Chea
(74) *Attorney, Agent, or Firm*—Baker Botts L.L.P.

(57) ABSTRACT

A photothermographic recording material comprising a support and a photo-addressable thermally developable element comprising photosensitive silver halide in catalytic association with a substantially light-insensitive organic silver salt, an organic reducing agent for the substantially light-insensitive organic silver salt in thermal working relationship therewith and a water-soluble or water-dispersible binder, characterized in that the substantially light-insensitive organic silver salt is a silver salt of an organic carboxylic acid, the photo-addressable thermally developable element further comprises a non-ionic or anionic surfactant and the photo-addressable thermally developable element is coatable from an aqueous medium and is capable of producing stable images without a wet-processing step; a process for producing the photothermographic recording material and a photothermographic recording process therefor.

18 Claims, 1 Drawing Sheet

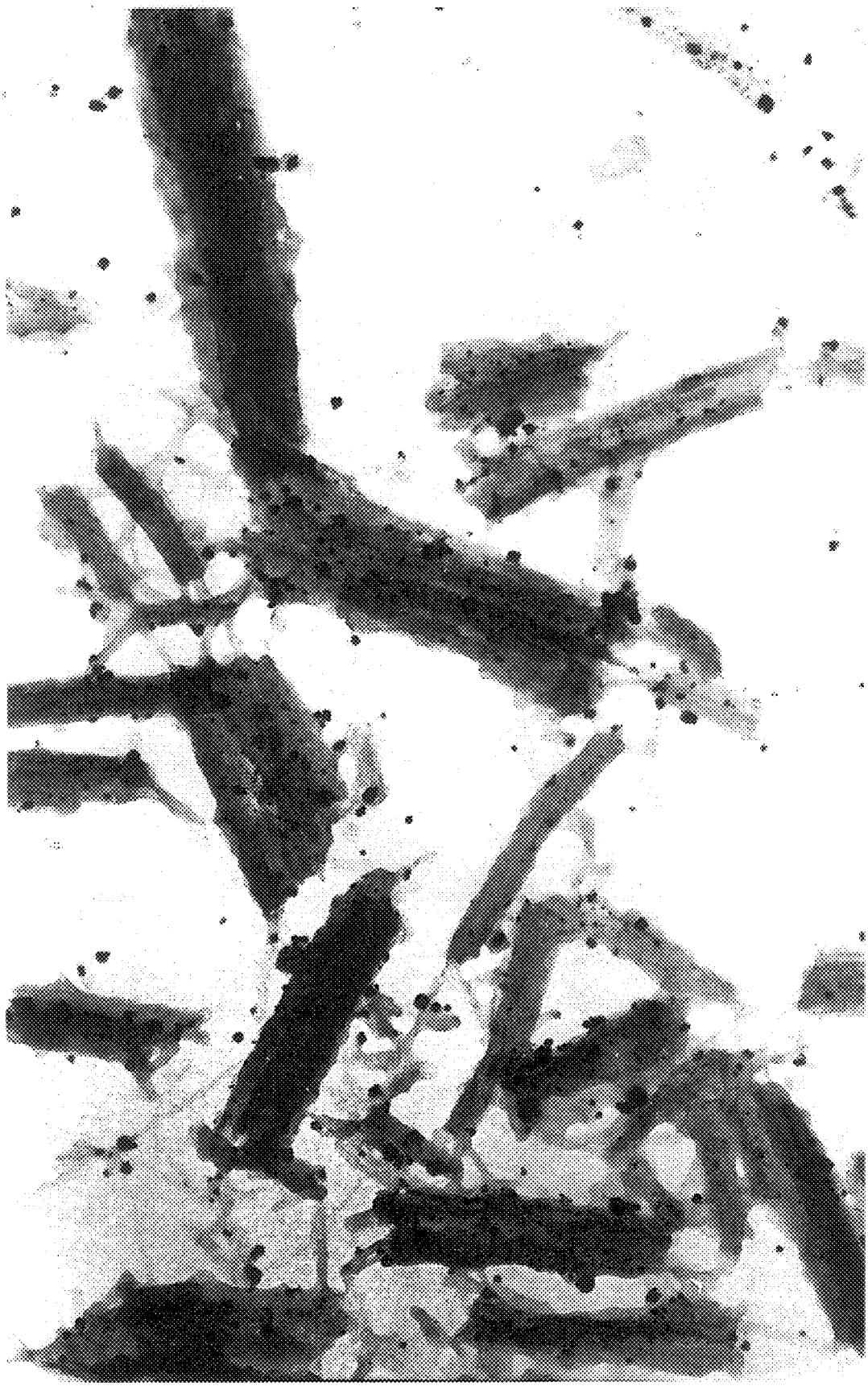

PHOTOTHERMOGRAPHIC RECORDING MATERIAL COATABLE FROM AN ACQUEOUS MEDIUM

This is a continuation of International Application PCT/EP96/04356, with an international filing date of Jun. 13, 1996.

DESCRIPTION

1. Field of the Invention

The present invention relates to a photothermographic recording material comprising a photo-addressable thermally developable element coatable from aqueous media.

2. Background of the Invention

Thermal imaging or thermography is a recording process wherein images are generated by the use of thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element containing other of the ingredients necessary for said chemical or physical process followed by uniform heating to bring about said changes in colour or optical density.

3. Thermal dye transfer printing wherein a visible image pattern is formed by transfer of a coloured species from an imagewise heated donor element onto a receptor element.

Thermographic materials of type 1 can be rendered photothermographic by incorporating a photosensitive agent which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over said sheet, and as the image forming component an oxidation-reduction reaction combination which is substantially latent under ambient conditions and which can be initiated into reaction by said free metal to produce a visible change in colour comprising an organic silver salt containing carbon atoms and different from said heavy metal salt as an oxidizing agent and in addition an organic reducing agent containing carbon atoms, said radiation-sensitive heavy metal salt being present in an amount between about 50 and about 1000 parts per million of said oxidation-reduction reaction combination.

The standard teaching over such photothermographic materials based on a substantially light-insensitive organic silver salt, photosensitive silver halide in intimate catalytic association with the organic silver salt and a reducing agent for the organic silver salt is that the organic silver salt is formed, optionally in the presence of ex situ formed silver halide, in an aqueous medium and is precipitated and dried before dispersion in an organic solvent medium from which the dispersion is coated, the silver halide either being prepared ex situ, and either added to a dispersion of the organic silver salt as described in U.S. Pat. No. 3,080,254 or being present during the formation of the organic silver salt as disclosed in U.S. Pat. No. 3,839,049, or being prepared in situ from the organic silver salt by reaction with a halide ion source as disclosed in U.S. Pat. No. 3,457,075. In the latter case reaction of organic silver salt with a halide ion source, which can be inorganic or organic, occurs after the dispersion of the organic silver salt in a solvent medium and hence the reaction takes place in a non-aqueous medium.

This production method is very inefficient as the organic silver salt after formation in water has to be separated and dried before dispersion in a solvent medium, is environmentally unsound as evaporation of solvent takes place during the coating process and it involves lengthy utilization of plant during the preparation of the organic silver salt dispersion and coating requires costly plant due to the need for solvent explosion prevention measures and solvent recovery to prevent solvent emission to the environment.

Furthermore, it is desirable spectrally to sensitize photosensitive silver halide in water-containing media as this permits the use of a broader range of spectrally sensitizing dyes.

The invention of U.S. Pat. No. 4,529,689 attempts to remedy this deficiency by disclosing a photothermographic film composition comprising (a) a substantially light-insensitive silver sulfinate, (b) a photographic silver halide emulsion, (c) a developing (reducing) agent, and (d) a binder; characterized in that the silver sulfinate is selected from the group consisting of silver hexadecylsulfinate, silver dodecylsulfinate, silver nonylsulfinate, silver 3-phenylpropylsulfinate, and silver cyclohexylsulfinate, and wherein the binder is a latex. In the detailed description of U.S. Pat. No. 4,529,689 the following surfactants useful for the latex are mentioned: dioctyl sodium sulfosuccinate, sodium lauryl sulfate, p-tertiary octylphenoxy ethoxy ethyl sulfonate together with "other surfactants known in the art of emulsion polymerization" and in the examples one anionic dispersing agent is mentioned: polystyrene sulfonate in the dispersing of Phenidone B; and three non-ionic surfactants are mentioned: Triton™ X-100, octylphenoxy polyethoxy ethanol, as a dispersant for silver hexadecylsulfinate in deionized water, Igepal™ CA-890 from GAF, an octylpoly (ethyleneoxy)ethanol, and Zonyl™ FSN, a fluorinated alkyl polyoxyethylene ethanol. Furthermore, in all the examples according to the invention disclosed in U.S. Pat. No. 4,529,689, it is necessary after exposure and thermal development of the photothermographic film composition to fix it for 1 minute with ammonium thiosulfate followed by washing in running water and drying to avoid print up (darkening) of the unexposed areas of the image. This necessity for the wet fixing of the photothermographic film compositions disclosed in the invention examples of U.S. Pat. No. 4,529,689 removes the essential advantage of so-called "Dry Silver" photo-thermographic materials over classical silver halide emulsion materials namely the avoidance of wet processing.

U.S. Pat. No. 4,504,575 discloses a photothermographic film comprising a silver salt as physical developer, a silver halide as photocatalyst, and a binder, wherein the improvement comprises using a light-insensitive silver sulfonate as the physical developer in combination with an organic base and wherein the silver sulfonate is silver dodecylsulfonate or silver hexadecylsulfonate. In the detailed description of U.S. Pat. No. 4,504,575 it is stated that, "Nonionic and anionic surfactants are preferred with these (polymer) lattices e.g. octylphenoxy poly(ethyleneoxy)ethanol, nonyl phenoxy poly(ethyleneoxy)ethanol, sodium dodecyl sulfonate and p-tertiary octyl phenoxyethoxyethyl sulfonate" and the non-ionic surfactants: Igepal™ CA-890 from GAF, an octylpoly (ethyleneoxy)ethanol, Triton™ X-100, an octylphenoxy polyethoxy ethanol and Zonyl™ FSN, a fluorinated alkyl polyoxyethylene ethanol, are used in the examples. However, swabbing with a 5% ethanolic solution of phenyl mercaptotetrazole or a 5% ethanolic solution of p-toluenesulfonic acid is necessary, according to the invention examples, to prevent print-up, thereby removing the essential advantage of so-called "Dry Silver" photothermographic materials over classical silver halide emulsion materials, namely the avoidance of wet processing.

Thus, despite forty years of continuous research in this area, a production method for photothermographic materials based on a substantially light-insensitive organic silver salt, photosensitive silver halide in intimate catalytic association with the organic silver salt and a reducing agent for the organic silver salt which dispenses with these disadvantages of the current teaching, has to our knowledge not yet been developed.

OBJECTS OF THE INVENTION

It is a first object of the invention to provide a photothermographic recording material comprising a photo-addressable thermally developable element with excellent image-forming properties.

It is a second object of the invention to provide a photothermographic recording material comprising a photo-addressable thermally developable element based on a substantially light-insensitive silver salt of an organic carboxylic acid, photosensitive silver halide in catalytic association therewith and an organic reducing agent for the silver salt of an organic carboxylic acid, which is produceable without necessitating intermediate drying of the silver salt of an organic carboxylic acid acid.

It is another object of the invention to provide a photothermographic recording material comprising a photo-addressable thermally developable element based on a substantially light-insensitive silver salt of an organic carboxylic acid, photosensitive silver halide in catalytic association therewith and an organic reducing agent for the silver salt of an organic carboxylic acid, which is coatable from an aqueous medium.

It is a further object of the invention to provide a photothermographic recording material with reduced print up after image formation without a wet processing step.

It is a still further object of the invention to provide a photothermographic recording material not requiring a wet processing step in order to obtain a stable image.

It is a yet a still further object of the invention to provide a recording process for a photothermographic recording material with the above improved characteristics.

Further objects and advantages of the invention will become apparent from the description hereinafter.

SUMMARY OF THE INVENTION

According to the present invention a photothermographic recording material is provided comprising a support and a photo-addressable thermally developable element comprising photosensitive siver halide in catalytic association with a substantially light-insensitive organic silver salt, an organic reducing agent for the substantially light-insensitive organic silver salt in thermal working relationship therewith and a water-soluble or water-dispersible binder, characterized in that the substantially light-insensitive organic silver salt is a silver salt of an organic carboxylic acid and the photo-addressable thermally developable element further comprises a non-ionic or anionic surfactant. The photo-addressable thermally developable element is coated from an aqueous medium and is capable of producing stable images without a wet-processing step.

A process is also provided producing a photothermographic recording material, as referred to above, comprising the steps of: (i) producing a suspension of particles of a substantially light-insensitive silver salt of an organic carboxylic acid; (ii) producing an aqueous dispersion or aqueous dispersions containing ingredients necessary for photothermographic image formation; (iii) coating the aqueous dispersion or aqueous dispersions onto a support.

A photothermographic recording process is further provided comprising the steps of: (i) image-wise exposing a photothermographic recording material, as referred to above, to a source of actinic radiation to which the photothermographic recording material is sensitive; and (ii) thermally developing said image-wise exposed photothermographic recording material.

Preferred embodiments of the present invention are disclosed in the detailed description of the invention.

DETAILED DESCRIPTION OF THE INVENTION

The invention is described hereinafter by way of examples with reference to the accompanying FIGURE wherein:

FIG. 1: shows a transmission electron micrograph at a magnification of 50,000× of the silver behenate/silver bromide dispersion produced in the course of the preparation of invention example 18.

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc; glycols e.g. ethylene glycol; glycerine; N-methyl pyrrolidone; methoxypropanol; and ketones e.g. 2-propanone and 2-butanone etc.

Surfactants

Non-ionic or anionic surfactants, according to the present invention, may be used to produce dispersions of particles of the substantially light-insensitive silver salt of an organic carboxylic acid in aqueous media and to disperse water-dispersible binders, such as polymer latexes, in aqueous media. A mixture of non-ionic and anionic surfactacts may also be used, according to the present invention.

In a preferred embodiment of the present invention the anionic surfactant is a sulfonate e.g. alkyl, aryl, alkaryl or aralkyl sulfonate, with alkyl and alkaryl sulfonates being particularly preferred.

In a further embodiment of the present invention the ionic surfactant is a non-ionic surfactant for example alkyl, aryl, alkaryl or aralkyl polyethoxy ethanols. Preferred non-ionic surfactants, according to the present invention, are alkoxy-polyethoxy ethanols and alkaryloxy-polyethoxy ethanols.

Suitable non-ionic surfactants according to the present invention are:

NON 01: GAFAC™ RM710, an alkylphenoxy polyethoxy dihydrogen-phosphate from GENERAL ANILINE;

NON 02: ANTAROX™ B290, a condensation product of caster oil with a ca. 40 unit long polyethyleneoxide chain from GENERAL ANILINE;

NON 03: ANTAROX™ C0880, nonylphenoxy polyethoxy ethanol with about 30 polyethoxy units from GENERAL ANILINE;

and suitable anionic surfactants according to the present invention are:

AN 01: ULTRAVON™ W, a sodium salt of an alkaryl sulfonate from CIBA-GEIGY;

AN 02: MERSOLAT™ H, a sodium salt of an alkyl sulfonate from BAYER;

AN 03: MARLON™ A-396, a sodium salt of dodecylbenzene sulfonate from HOLS;

AN 04: AEROSOL™ OT, a sodium salt of the bis-(2'-ethylhexyl) ester of sulfosuccinic acid from AMERICAN CYANAMID;

AN 05: HOSTAPON™ T, a sodium β-(methyl-oleylamino)ethylsulfonate from HOECHST;

AN 06: HOSTAPAL™ BV, a sodium 2,4,6-tributylphenoxy polyethoxy sulfonate from HOECHST;

AN 07: NEFAL™ BX, a sodium salt of 4,7-dibutyl-2-sulfonaphthalene from BASF;

AN 08: AKYPO™ OP-80, a sodium salt of octylphenoxy-polyethoxy-acetic acid from CHEMY;

AN 09: TERGITOLT™ 4, a sodium salt of 1-isobutyl-4-ethyl-octyl-sulfate from UNION CARBIDE;

AN 10: ERKANTOL™ BX, a sodium salt of 4,7-bis (isobutyl)-2-naphthalenesulfonic acid from BAYER;

AN 11: ALKANOLT™ XC, a sodium salt of tris (isopropyl)naphthalene-sulfonic acid from DU PONT.

Water-dispersible and water-soluble binders

According to the present invention the photo-addressable thermally developable element comprises a binder comprising a water-soluble binder, a water-dispersible binder or a mixture of a water soluble binder and a water-dispersible binder. An important prerequisite in the choice of binders and binder-mixtures is their ability to form a continuous layer with the other ingredients present.

In a preferred embodiment of the present invention the binder is a polymer latex.

In a particularly preferred embodiment the binder is a polymer comprising monomer units selected from the group consisting of a diene-monomer and a methacrylate.

In another particularly preferred embodiment the binder is a polymer comprising monomer units selected from the group consisting of styrene and an acrylate.

An important prerequisite in the choice of binders is their ability to form a continuous layer with the other ingredients present.

The water-dispersible binder can be any water-insoluble polymer e.g. water-insoluble cellulose derivatives, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed under the trade name BUTVAR B79 of Monsanto USA and provides a good adhesion to paper and properly subbed polyester supports. It should be noted that there is no clear cut transition between a polymer dispersion and a polymer solution in the case of very small polymer particles resulting in the smallest particles of the polymer being dissolved and those slightly larger being in dispersion.

Suitable water-soluble polymers, according to the present invention, are: polyvinyl alcohol, polyacrylamide, polyacrylic acid, polymethacrylic acid, polyethyleneglycol, proteins, such as gelatin and modified gelatins such as phthaloyl gelatin, polysaccharides, such as starch, gum arabic and dextran and water-soluble cellulose derivatives.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Photo-addressable thermally developable element

The photo-addressable thermally developable element, according to the present invention, comprises a substantially light-insensitive silver salt of an organic carboxylic acid, photosensitive silver halide in catalytic association therewith and an organic reducing agent in thermal working relationship with the substantially light-insensitive silver salt of an organic carboxylic acid and a water soluble or water-dispersible binder. The element may comprise a layer system with the silver halide in catalytic association with the substantially light-insensitive silver salt of an organic carboxylic acid, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive silver salt of an organic carboxylic acid i.e. during the thermal development process the reducing agent and the toning agent, if present, are able to diffuse to the substantially light-insensitive silver salt of an organic carboxylic acid.

Light-insensitive silver salts of organic carboxylic acids

Preferred substantially light-insensitive organic silver salts produced using the process according to the present invention and used in the photothermographic materials, according to the present invention, are silver salts of organic carboxylic acids having as their organic group: aryl, aralkyl, alkaryl or alkyl. For example aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group, as described e.g. in GB-P 1,111,492, may likewise be used to produce a thermally developable silver image.

In a preferred embodiment, according to the present invention, the substantially light-insensitive silver salt of an organic carboxylic acid is a silver salt of a fatty acid.

The term substantially light-insensitive silver salt of an organic carboxylic acid for the purposes of the present invention also includes mixtures of silver salts of organic carboxylic acids.

Binder to silver salt of an organic carboxylic acid ratio

The binder to silver salt of an organic carboxylic acid weight ratio is preferably in the range of 0.2 to 6, and the thickness of the recording layer is preferably in the range of 1 to 50 μm.

Production of particles of silver salt of an organic carboxylic acid

Particles of the silver salts of organic carboxylic acids are prepared by the reaction of a soluble silver salt with the organic carboxylic acid or a salt thereof.

According to a process, according to the present invention, the suspension of particles of a substantially light-insensitive silver salt of an organic carboxylic acid may be produced by simultaneous metered addition of an aqueous solution or suspension of an organic carboxylic acid, or its salt, and an aqueous solution of a silver salt to an aqueous liquid and the metered addition of the aqueous solution or suspension of the organic carboxylic acid or its salt; and/or the aqueous solution of the silver salt is regulated by the concentration of silver ions or the concentration of anions of the silver salt in the aqueous liquid.

This metered addition may be regulated by varying the rate of addition of said solution or suspension of the organic carboxylic acid or its salt; and/or the rate of addition of said solution of said silver salt so as to maintain the value of a physical parameter, that significantly changes upon the addition of the solution or suspension of the organic carboxylic acid or its salt and/or said solution of said silver salt to said liquid, at a particular value predetermined for a particular moment in said process. The value of the physical parameter used to regulate the addition of the solution or suspension of an organic carboxylic acid or its salt and/or said solution of said silver salt to said liquid may vary during the course of the production process.

Furthermore, the physical parameter used to regulate the metered addition of the solution or suspension of the organic carboxylic acid or its salt; and/or said solution of said silver salt, according to the present invention, may be the concentration of silver ions or the concentration of anions of the silver salt in said liquid. Other physical parameters that may be used to regulate the metered addition of said solutions are, for example, the electrical conductivity of the suspending medium, the dielectric constant of the suspending medium, the density of the suspending medium, the pH of the suspending medium etc.

The temperatures of the solution or suspension of the organic carboxylic acid or its salt; said solution of said silver salt; and said liquid are determined by the required characteristics of said particles; and may be kept constant or may be varied during the synthesis of the silver salt of a organic carboxylic acid again depending upon the required characteristics of the particles.

The liquid for suspending the particles may contain a non-ionic or anionic surfactant for said particles. Such surfactants may also be present in the solution or suspension of the organic carboxylic acid or its salt; and in the solution of the silver salt; may be added via an additional jet during the production process of the suspension of particles containing a substantially light-insensitive silver salt of a organic carboxylic acid; and may be added at the end of said production process.

A process for producing a photothermographic recording material, according to the present invention, is also provided, wherein the process further comprises the step of producing particles of the photosensitive silver halide from excess silver ions associated with particles of the substantially light-insensitive silver salt of an organic carboxylic acid.

The regulated excess of silver ions during said production of the particles may be achieved by maintaining the UAg of said liquid, defined as the potential difference between a silver electrode (of ≧99.99% purity) in the liquid and a reference electrode consisting of a Ag/AgCl-electrode in 3M KCl solution at room temperature connected with said liquid via a salt bridge consisting of a 10% $KNO_3$ salt solution, at 70° C. at at least 380 mV.

During or after completion of the production of the suspension, salts produced during the process and any excess dissolved ions, for example silver ions, may be removed by on-line or off-line desalting processes such as dialysis or ultrafiltration. Desalting of the suspension may also be achieved after completion of the production process by precipitation of the suspension, followed by decantation, washing and redispersion.

Furthermore, the suspending medium may be changed from a hydrophilic to a hydrophobic suspending medium.

A process according to the present invention may be carried out batchwise or in continuous mode in any suitable recipient.

Photosensitive silver halide

The photosensitive silver halide used in the present invention may be employed in a range of 0.1 to 35 mol percent of substantially light-insensitive silver salt of an organic carboxylic acid, with the range of 0.5 to 20 mol percent being preferred and the range of 1 to 12 mol percent being particularly preferred.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of silver salt of an organic carboxylic acid and photosensitive silver halide The silver halide may be added to the photo-addressable thermally developable element in any fashion which places it in catalytic proximity to the substantially light-insensitive silver salt of an organic carboxylic acid. Silver halide and the substantially light-insensitive silver salt of an organic carboxylic acid which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the silver salt of an organic carboxylic acid to partially convert the substantially light-insensitive silver salt of an organic carboxylic acid to silver halide as disclosed in U.S. Pat. No. 3,457,075.

According to a preferred embodiment according to the present invention, particles of the photosensitive silver halide are non-aggregating in the photo-addressable thermally developable element and are uniformly distributed over and between particles of the substantially light-insensitive silver salt of an organic carboxylic acid, at least 80% by number of said particles having a diameter, determined by transmission electron microscopy, of ≦40nm.

According to another preferred embodiment according to the present invention, a production process for the photothermographic recording material is provided further comprising the step of forming particles of said photosensitive silver halide by reacting an aqueous emulsion of particles of said substantially light-insensitive silver salt of an organic carboxylic acid with at least one onium salt with halide or polyhalide anion(s).

According to a process, according to a still further preferred embodiment of the present invention, particles of the photosensitive silver halide are produced from excess silver ions associated with particles of the substantially light-insensitive silver salt of a organic carboxylic acid produced by simultaneous metered addition of a solution or suspension of a organic carboxylic acid, or its salt, and a solution of a silver salt to a liquid. Agents used for converting the excess dissolved silver ions into a silver salt may be inorganic halides, such as metallic halides e.g. KBr, KI, $CaBr_2$, $CaI_2$ etc.; or ammonium halides.

In a further embodiment, according to the present invention, production of said suspension of particles containing a substantially light-insensitive silver salt is immediately followed by the production of silver halide "in-situ" in the same recipient, thereby producing a photosensitive suspension.

The aqueous emulsion of the silver salt of an organic carboxylic acid optionally including photosensitive silver halide can, according to the present invention, also be produced from particles of the silver salt of an organic carboxylic acid optionally containing photosensitive silver halide by dispersing the particles in water in the presence of non-ionic or anionic surfactants or a mixture of non-ionic and anionic surfactants using any dispersion technique known to one skilled in the art such as ball milling, dispersion in a impingement mill (rotor-stator mixer), dispersion in a microfluidizer etc. A combination of dispersion techniques may also be used, for example using a first technique to produce a predispersion and a second technique to produce a fine dispersion.

Onium halides and polyhalides

According to the present invention photosensitive silver halide particles produced by reacting an aqueous dispersion of particles of the substantially light-insensitive silver salt of an organic carboxylic acid with at least one onium salt with halide or polyhalide anions may be present. The halide or polyhalide onium salts may be added as solids or solutions or may be formed in the aqueous dispersion of particles of the substantially light-insensitive silver salt by metathesis between a salt with halide or polyhalide anions and onium salts with anions other than halide or polyhalide.

Preferred oniums according to the present invention are organo-phosphonium, organo-sulphonium and organo-nitrogen onium cations, with heterocyclic nitrogen onium (e.g. pyridinium), quaternary phosphonium and ternary sulphonium cations being preferred. Preferred halide anions, according to the present invention, are chloride, bromide and iodide. Preferred polyhalide anions, according to the present invention, consist of chlorine, bromine and iodine atoms.

Onium cations, according to the present invention, may be polymeric or non-polymeric. Preferred non-polymeric onium salts for partial conversion of particles of substantially light-insensitive silver salt of an organic carboxylic acid into photosensitive silver halides according to the present invention are:

PC01=3-(triphenyl-phosphonium)propionic acid bromide perbromide

PC02=3-(triphenyl-phosphonium)propionic acid bromide

PC03=3-(triphenyl-phosphonium)propionic acid iodide

The onium salts are present in quantities of between 0.1 and 35 mol % with respect to the quantity of substantially light-insensitive organic silver salt of organic, with quantities between 0.5 and 20mol % being preferred and with quantities between 1 and 12mol % being particularly preferred.

Organic reducing agent

Suitable organic reducing agents for the reduction of said substantially light-insensitive organic heavy metal salts are organic compounds containing at least one active hydrogen atom linked to O, N or C. Particularly suitable organic reducing agents for the reduction of the substantially light-insensitive silver salt of an organic carboxylic acid, an organic reducing agent for the substantially light-insensitive silver salt of an organic carboxylic acid are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annelated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group.

In preferred reducing agents, the ring atoms of the non-sulfo-substituted 6-membered aromatic or heteroaromatic ring compound consist of nitrogen and carbon ring atoms and the non-sulfo-substituted 6-membered aromatic or heteroaromatic ring compound is annelated with an aromatic or heteroaromatic ring system.

In further preferred reducing agents, the non-sulfo-substituted 6-membered aromatic or heteroaromatic ring compound is substituted with one or more of the following substituents which may also be substituted: alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl.

Particularly preferred reducing agents are substituted catechols or substitued hydroquinones with 3-(3',4'-dihydroxyphenyl)-propionic acid, 3',4'-dihydroxybutyrophenone, methyl gallate, ethyl gallate and 1,5-dihydroxy-naphthalene being especially preferred.

During the thermal development process the reducing agent must be present in such a way that it is able to diffuse to said substantially light-insensitive silver salt of an organic carboxylic acid particles so that reduction of said substantially light-insensitive silver salt of an organic carboxylic acid can take place.

Auxiliary reducing agents

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

Spectral sensitizer

According to a preferred embodiment of the present invention, the photo-addressable thermally developable element of the photothermographic recording material further comprises a dye with maximum absorbance in the wavelength range 600 to 1100 nm.

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Thermal solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants, e.g. the reducing agent for the substantially light-insensitive silver salt of an organic carboxylic acid, at a temperature above 60° C. Useful for said purpose are the polyethylene glycols having a mean molecular weight in the range of 1,500 to 20,000 described in U.S. Pat. No. 3,347,675. Other suitable heat solvents are compounds such as urea, methyl sulfonamide and ethylene carbonate as described in U.S. Pat. No. 3,667,959; compounds such as tetrahydro-thiophene-1,1-dioxide, methyl anisate and 1,10-decanediol as described in Research Disclosure 15027 published in December 1976; and those described in U.S. Pat. No. 3,438,776, U.S. Pat. No. 4,740,446, U.S. Pat. No. 5,368,979, EP-A 0 119 615, EP-A 122 512 and DE-A 3 339 810.

Toning agents

In order to obtain a neutral black image tone in the higher densities and neutral grey in the lower densities, photothermographic materials according to the present invention may contain one or more toning agents. Said toning agents should be in thermal working relationship with said substantially light-insensitive silver salt of an organic carboxylic acids and reducing agents during thermal processing. Any known toning agent from thermography or photothermography may be used.

Suitable toning agents are succinimide and the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type within the scope of following general formula are described in GB-P 1,439,478 and U.S. Pat. No. 3,951,660:

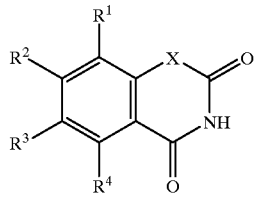

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring.

A toner compound, according to the above general formula, particularly suited for use in combination with polyhydroxy benzene reducing agents is benzo[e] [1,3] oxazine-2,4-dione.

Stabilizers and antifoggants

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Additional ingredients

In addition to said ingredients the photothermographic material may contain other additives such as free organic carboxylic acids, surface-active agents, antistatic agents, e.g. non-ionic antistatic agents including a fluorocarbon group as e.g. in $F_3C(CF_2)_6CONH(CH_2CH_2O)$-H, silicone oil, e.g.

BAYSILONE Ö1 A (tradename of BAYER AG - GERMANY), ultraviolet light absorbing compounds, white light reflecting and/or ultraviolet radiation reflecting pigments, silica, and/or optical brightening agents.

Antihalation dyes

In addition to said ingredients, the photothermographic recording material of the present invention may contain anti-halation or acutance dyes which absorb light which has passed through the photosensitive layer, thereby preventing its reflection. Such dyes may be incorporated into the photo-addressable thermally developable element or in any other layer comprising the photothermographic recording material of the present invention. The anti-halation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4,548,896, 4,594,312, 4,977,070, 5,258,274, 5,314,795 and 5,312,721, or photo-bleached after removable after the thermal development process, as disclosed in the U.S. Pat. Nos. 3,984,248, 3,988,154, 3,988,156, 4,111,699 and 4,359,524. Furthermore the anti-halation layer may be contained in a layer which can be removed subsequent to the exposure process, as disclosed in U.S. Pat. No. 4,477,562 and EP-A 491 457. Suitable anti-halation dyes for use with infra-red light are described in the EP-A's 377 961 and 652 473, the EP-B's 101 646 and 102 781 and the U.S. Pat. Nos. 4,581,325 and 5,380,635.

Support

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and the paper base substrate.

The support may be in sheet, ribbon or web form and subbed if needs be to improve the adherence to the thereon coated heat-sensitive recording layer.

Suitable subbing layers for improving the adherence of the thermosensitive element and the antistatic layer outermost backing layer of the present invention for polyethylene terephthalate supports are described e.g. in GB-P 1,234,755, U.S. Pat. Nos. 3,397,988; 3,649,336; 4,123,278 and U.S. Pat. No. 4,478,907 which relates to subbing layers applied from aqueous dispersion of sulfonated copolyesters, and further the subbing layers described in Research Disclosure published in Product Licensing Index, July 1967, p. 6.

Suitable pretreatments of hydrophobic resin supports are, for example, treatment with a corona discharge and/or attack by solvent(s), thereby providing a micro-roughening.

The support may be made of an opacified resin composition, e.g. polyethylene terephthalate opacified by means of pigments and/or micro-voids, and/or may be coated with an opaque pigment-binder layer, and may be called synthetic paper, or paperlike film. Information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

Protective layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders polycarbonates as described in EP-A 614 769 are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol organic carboxylic acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and organic carboxylic acids. Suitable slipping layer compositions are described in e.g. EP 138483, EP 227090, U.S. Pat. Nos. 4,567,113, 4,572,860 and 4,717,711 and in EP-A 311841.

A suitable slipping layer being a layer comprising as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Other suitable protective layer compositions that may be applied as slipping (anti-stick) coating are described e.g. in published European patent applications (EP-A) 0 501 072 and 0 492 411.

Such protective layers may also comprise particulate material, e.g. talc particles, optionally protruding from the protective outermost layer as described in WO 94/11198.

Other additives can also be incorporated in the protective layer e.g. colloidal particles such as colloidal silica.

Antistatic layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating techniques

The coating of any layer of the photothermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Recording process

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Applications

The photothermographic recording materials of the present invention can be used for both the production of transparencies and reflection type prints. This means that the support will be transparent or opaque, e.g. having a white light reflecting aspect.

For example, a paper base substrate is present which may contain white reflecting pigments, optionally also applied in an interlayer between the recording material and said paper base substrate. Should a transparent base be used, said base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

The following ingredients in addition to those mentioned above were used in the photothermographic recording materials of the examples and comparative examples illustrating this invention:

the cationic surfactants:

CAT 01: HYAMINE™ 10×, a benzyl-dimethyl-[methyl-4'-(1",1",3",3"-tetramethylbutyl)phenyl-3,6-dioxyhexyl]ammonium bromide from LONZA in which the bromide ion has been replaced with a nitrate ion;

CAT 02: cetyl-trimethylammonium nitrate;

the proteinaceous binders:

GELATIN 01: type K7598 from AGFA GELATINFABRIK vorm. KOEPFF & SOEHNE (a low viscosity gelatin);

GELATIN 02: type K16353 from AGFA GELATINFABRIK vorm. KOEPFF & SOEHNE (a high viscosity gelatin);

and the latex binders:

BINDER 01: copolymer consisting of 45% by weight of methylmethacrylate, 45% by weight of butadiene and 10% by weight of itaconic acid;

BINDER 02: terpolymer consisting of 85% by weight of butyl-methacrylate, 10% by weight of butylacrylate and 5% by weight of N-diaceton acrylamide.

The following examples and comparative examples illustrate the present invention. The percentages and ratios used in the examples are by weight unless otherwise indicated.

COMPARATIVE EXAMPLE 1

Extrapolation of the state of the art regarding photothermographic materials based on organic silver sulfinates disclosed in U.S. Pat. No. 4,529,689 to photothermographic materials based on silver salts of organic carboxylic acids:

Silver heaxadecylsulfinate dispersion 5 g of silver hexadecylsulfinate was mixed with 12.5 mL of a 10% by weight aqueous solution of the non-ionic surfactant NON 03 and 82.5 g of deionized water in a ball mill to produce a fine and stable dispersion of silver hexadecylsulfinate.

Partial conversion to photosensitive silver bromide and coating, drying and processing of the photothermographic material EXPERIMENT A (=Invention example 13 in U.S. Pat. No. 4,529,689):

The following ingredients were added with stirring to 6.8 g of the silver hexadecylsulfinate dispersion: 1 g of a 20% by weight aqueous dispersion of BINDER 02 (a latex used in the invention examples of U.S. Pat. No. 4,529,689), 0.4 g of a 0.15N aqueous solution of potassium bromide (to convert partially the silver hexadecyl-sulfinate to silver bromide) and 1.44 g of a 5% methanolic solution of 4-methyl-1-phenyl-pyrazolidin-3-one (Phenidone B).

A subbed polyethylene terephthalate support having a thickness of 100 μm was then doctor blade-coated with the resulting silver hexadecylsulfinate/silver bromide dispersion to a wet layer thickness of 90 μm. After drying for several minutes at 40° C. on the coating bed, the dispersion layer was dried for 1 hour in a hot air drying cupboard at 50° C. in the dark.

EXPERIMENT B:

The following ingredients were added with stirring to 6.8 g of the silver hexadecylsulfinate dispersion: 1 g of a 20% aqueous dispersion of BINDER 02 (a latex used in the invention examples of U.S. Pat. No. 4,529,689), 0.6g of a 5% aqueous solution of GELATIN 02 at 40° C. and 0.4 g of a 0.15N aqueous solution of potassium bromide (to convert partially the silver hexadecyl-sulfinate to silver bromide).

A subbed polyethylene terephthalate support having a thickness of 100 μm was then doctor blade-coated with the resulting silver hexadecyl-sulfinate/silver bromide dispersion to a wet layer thickness of 90 μm. After drying for several minutes at 40° C. on the coating bed, the dried layer was coated with a 2.5% methanolic solution of 4-methyl-1-phenyl-pyrazolidin-3-one (Phenidone B). After drying on the coating bed, the resulting layer was dried for 1 hour in a hot air drying cupboard at 50° C. in the dark.

EXPERIMENT C:

EXPERIMENT C was carried out as described above for EXPERIMENT B, except that the addition of the 5% solution of GELATIN 02 was omitted.

EXPERIMENT D:

EXPERIMENT D was carried out as described for EXPERIMENT C, except that the quantity of the 20% aqueous dispersion of BINDER 02 was increased from 1 g to 4.2 g.

Image-wise exposure and thermal processing

The photothermographic materials produced in experiments A, B, C and D of COMPARATIVE EXAMPLE 1 were then exposed to ultra-violet light through a test original in contact with the material in an Agfa-Gevaert™ DL 2000 exposure apparatus followed by heating on a heated metal block for 10 s at 95° C. to produce a very good image with a high contrast and good sharpness. The quality of the images obtained was assessed qualitatively and awarded a numerical score between 0 and 5 where these values correspond to:

0=no image

1=a very weak image

2=a weak image

3=a moderate image quality

4=a good image

5=a very good image with high contrast and good sharpness

The photothermographic materials from EXPERIMENTS A, B, C and D all exhibited a noticeably increased optical density after coating and drying. Image-wise exposure followed by thermal processing produced an increase in optical density, but without image discrimination for all the materials. All materials of EXPERIMENTS A, B, C and D were, therefore, all awarded a score of 0 for image quality.

The very poor imaging results obtained with the photothermographic materials of COMPARATIVE EXAMPLE 1 make the use of non-ionic surfactants such as ANTARO™ C0880 (NON 03), nonylphenoxy polyethoxy ethanol, used in the present experiments or TRITON™ X-100, octylphenoxy polyethoxy ethanol, used in invention examples of U.S. Pat. No. 4,529,689 as surfactants for other silver salt of an organic carboxylic acids such as the silver salts of organic carboxylic acids of the present invention not obvious to one skilled in the art.

COMPARATIVE EXAMPLE 2

Extrapolation of the state of the art regarding photothermographic materials based on organic silver sulfonates disclosed in U.S. Pat. No. 4,504,575 to photothermographic materials based on silver salts of organic carboxylic acids:

Silver heaxadecylsulfonate dispersion 5 g of silver hexadecylsulfonate was mixed with 12.5 mL of a 10% by weight aqueous solution of the non-ionic surfactant NON 03 and 82.5 g of deionized water in a ball mill to produce a fine and stable dispersion of silver hexadecylsulfinate.

Partial conversion to photosensitive silver bromide and coating, drying and processing of the photothermographic material

EXPERIMENT A:

EXPERIMENT A was carried out as described above for EXPERIMENT B of COMPARATIVE EXAMPLE 1, except that silver hexadecylsulfonate was substituted for silver hexadecylsulfinate.

EXPERIMENT B:

EXPERIMENT B was carried out as described above for EXPERIMENT A, except that the addition of the 5% solution of GELATIN 02 was omitted.

EXPERIMENT C:

EXPERIMENT C was carried out as described for EXPERIMENT B, except that the quantity of the 20% aqueous dispersion of BINDER 02 was increased from 1 g to 4.2 g.

Image-wise exposure and thermal processing

The photothermographic materials produced in experiments A, B and C of COMPARATIVE EXAMPLE 2 were then image-wise exposed and thermally processed as described for the photothermographic materials of COMPARATIVE EXAMPLE 1. The quality of the images obtained was assessed qualitatively as also described for the photothermographic materials of COMPARATIVE EXAMPLE 1.

The photothermographic materials from EXPERIMENTS A, B and C all exhibited a noticeably increased optical density after coating and drying. Image-wise exposure followed by thermal processing produced an increase in optical density, but only the photothermographic material of EXPERIMENT C exhibited any image discrimination and then only with poor contrast. The materials of EXPERIMENTS A, B and C were, therefore, awarded score of 0, 0 and 1 respectively for image quality.

The very poor imaging results obtained with the photothermographic materials of COMPARATIVE EXAMPLE 2 make the use of non-ionic surfactants, such as ANTAROX™ C0880 (NON 03) (nonylphenoxy polyethoxy ethanol) used in the present experiments or TRITON™ X-100 (octylphenoxy polyethoxy ethanol) used in the invention examples of U.S. Pat. No. 4,504,575, as surfactants for other organic silver salts such as the silver salts of organic carboxylic acids of the present invention not obvious to one skilled in the art.

INVENTION EXAMPLES 1 to 3

Silver behenate dispersion

Silver behenate was prepared by dissolving 34 g (0.1 moles) of behenic acid in 340 mL of 2-propanol at 65° C., converting the behenic acid to sodium behenate by adding 400 mL of 0.25M aqueous sodium hydroxide to the stirred behenic acid solution and finally adding 250 mL of 0.4M aqueous silver nitrate the silver behenate precipitating out. This was filtered off and then washed with a mixture of 10% by volume of 2-propanol and 90% by volume of deionized water to remove residual sodium nitrate. Finally the silver behenate was dried at 45° C. for 12 hours.

For each of the dispersions used in the preparation of the materials of INVENTION EXAMPLES 1 to 3, 100 g of silver behenate was mixed with the particular surfactant and quantity thereof given in table 1 for the particular invention example and deionized water was added to produce a total weight of 500 g.

The resulting mixture was then dispersed using a high speed impingement mill (rotor-stator mixer) to obtain a paste which was then further dispersed with a microfluidizer to yield an approximately 20% by weight fine dispersion of silver behenate, which did not flocculate out upon standing for 48 hours.

TABLE 1

| Invention example number | Surfactant used Type code | Concentration [% by weight] | Solvent | Quantity [g] | Flocculation ? |
|---|---|---|---|---|---|
| 1 | NON 01 | 10 | methanol | 150 | no |
| 2 | NON 02 | 10 | water/ethanol | 150 | no |
| 3 | NON 03 | 10 | water | 150 | no |

Partial conversion to photosensitive silver halide and coating, drying and processing of the photothermographic material The following ingredients were then added with stirring to 1.5 g of each of the dispersions produced: 1 g of a 30% by weight concentration of BINDER 01 in deionized water at a pH of 4, 1 g of a 2.23% by weight aqueous solution of 3-(triphenylphosphonium)propionic acid bromide (PC02), corresponding to a concentration of 8 mol % of PC01 with respect to silver behenate, to accomplish in situ conversion of part of the silver behenate to silver bromide at a pH of 4, 0.5 g of a 3.2% by weight aqueous solution of succinimide and 1 g of a 4.5% by weight aqueous solution of 3-(3',4'-dihydroxyphenyl)propionic acid.

A subbed polyethylene terephthalate support having a thickness of 100 μm was then doctor blade-coated with the silver behenate/silver bromide dispersion to a wet layer thickness of 90 μm. After drying for several minutes at 40° C. on the coating bed, the emulsion layer was dried for 1 hour in a hot air oven at 50° C.

Image-wise exposure and thermal development were carried out on the resulting photothermographic materials of INVENTION EXAMPLES 1 to 3 as described for COMPARATIVE EXAMPLE 1 and very good images with a high contrast and good sharpness were obtained in each case meriting a numerical score of 5.

INVENTION EXAMPLES 4 to 15

Silver behenate dispersion

Silver behenate was prepared as described for INVENTION EXAMPLES 1 to 3. For each of the dispersions used in the preparation of the materials of INVENTION EXAMPLES 4 to 15, 100 g of silver behenate was mixed with the particular surfactant and quantity thereof given in table 2 for the particular invention example and deionized water was added to produce a total weight of 500 g.

The resulting mixture was then dispersed using a high speed impingement mill (rotor-stator mixer) to obtain a paste which was then further dispersed with a microfluidizer to yield an approximately 20% by weight fine dispersion of silver behenate, which did not flocculate upon standing for 48 hours.

TABLE 2

| Invention example number | Surfactant used Type code | Concentration [% by weight] | Solvent | Quantity [g] | Flocculation ? |
|---|---|---|---|---|---|
| 4 | AN 01 | 9.4 | water/ethanol | 150 g | no |
| 5 | AN 02 | 25 | water | 60 | no |
| 6 | AN 01 | 9.4 | water/ethanol | 106 | no |
| | AN 02 | 25 | water | 4 | |

TABLE 2-continued

| Invention example number | Surfactant used Type code | Concentration [% by weight] | Solvent | Quantity [g] | Flocculation ? |
|---|---|---|---|---|---|
| 7 | AN 03 | 10 | water | 150 | no |
| 8 | AN 04 | 10 | water | 100 | no |
| 9 | AN 05 | 12.5 | water | 80 | no |
| 10 | AN 06 | 10 | water | 100 | no |
| 11 | AN 07 | 5 | water/ethanol | 200 | no |
| 12 | AN 08 | 5 | water | 200 | no |
| 13 | AN 09 | 5 | water | 300 | no |
| 14 | AN 10 | 5 | water | 200 | no |
| 15 | AN 11 | 10 | water | 100 | no |

Partial conversion to photosensitive silver halide and coating, drying and processing of the photothermographic material The following ingredients were then added with stirring to 1.5 g of each of the dispersions produced: 1 g of a 30% by weight concentration of BINDER 01 in deionized water at a pH of 4, 1 g of a 2.23% by weight aqueous solution of 3-(triphenylphosphonium)propionic acid bromide (PC02), corresponding to a concentration of 8 mol % of PC01 with respect to silver behenate, to accomplish in situ conversion of part of the silver behenate to silver bromide at a pH of 4, 0.5 g of a 3.2% by weight aqueous solution of succinimide and 1 g of a 4.5% by weight aqueous solution of 3-(3',4'-dihydroxyphenyl)propionic acid.

A subbed polyethylene terephthalate support having a thickness of 100 μm was doctor blade-coated with the silver behenate/silver bromide dispersion to a wet layer thickness of 90 μm. After drying for several minutes at 40° C. on the coating bed, the emulsion layer was dried for 1 hour in a hot air oven at 50° C.

Image-wise exposure and thermal development were carried out on the resulting photothermographic materials of INVENTION EXAMPLES 4 to 15 as described for COMPARATIVE EXAMPLE 1 and very good images with a high contrast and good sharpness were obtained in each case meriting a numerical score of 5.

COMPARATIVE EXAMPLES 3 and 4

Evaluation of cationic surfactants for use in the dispersions of silver salts of organic carboxylic acids:

The dispersions used in the preparation of the photothermographic recording materials of COMPARATIVE EXAMPLES 3 and 4 were prepared as described for those used in the preparation of the photothermographic recording materials of INVENTION EXAMPLES 1 to 3 except that other surfactants and surfactant quantities as given in table 3. The dispersions obtained by microfluidizing the predispersions were neither fine nor stable and flocculated in the microfluidizer.

Photothermographic coating emulsions were then prepared as described for INVENTION EXAMPLES 1 to 3, but doctor blade coating produced layers which were unsuitable for the photothermographic processing as described for INVENTION EXAMPLES 1 to 3.

TABLE 3

| Comparative example number | Surfactant used Type code | Concentration [% by weight] | Solvent | Quantity [g] | Flocculation ? |
|---|---|---|---|---|---|
| 1 | CAT 01 | 5 | water | 200 | yes |
| 2 | CAT 02 | 5 | water | 200 | yes |

Cationic surfactants are therefore unsuitable for use in the preparation of silver behenate dispersions for use in the coating of photo-addressable thermally developable elements from aqueous media.

INVENTION EXAMPLE 16

A sodium behenate solution was prepared by first dissolving 34 kg of behenic acid in 340 L of isopropanol at 65° C. and then adding with stirring a 0.25N solution of sodium hydroxide until a solution pH of 8.7 was obtained. This required about 400 L of 0.25N NaOH. The concentration of the resulting solution was then adjusted to a sodium behenate concentration of 8.9% by weight and a concentration of isopropanol in the solvent mixture of 16.7% by volume, by a combination of evaporation and dilution.

The silver behenate synthesis was carried out at a constant UAg of 400 mV as follows: to a stirred solution of 4.1 g of the anionic surfactant AN 01 and 0.41 g of a halide-free solution of the anionic surfactant AN 02 in 750 mL of distilled water at 72° C. in a double walled reactor, several drops of a 2.94M aqueous solution of silver nitrate were added to adjust the UAg at the start of the reaction to 400 mV and then 374 mL of the sodium behenate solution, whose preparation is described above, at a temperature of 78° C. was metered into said reactor at a rate of 8.3 mL/min and simultaneously a 2.94M aqueous solution of silver nitrate was metered into said reactor, its addition rate being controlled by the quantity of said silver nitrate solution necessary to maintain a UAg of 400±5 mV in the dispersing medium in said reactor. Both the sodium behenate and silver nitrate solutions were added to the dispersing medium via small diameter tubes positioned just under the surface of said dispersing medium.

By the end of the addition step 0.092 moles of sodium behenate and 0.108 moles of silver nitrate had been added. The mixture was then stirred for a further 30 minutes. A fine and stable silver behenate dispersion was obtained, which did not flocculate out upon standing for 48 hours.

INVENTION EXAMPLE 17

A silver behenate dispersion was prepared as described for INVENTION EXAMPLE 16, except that the dispersing medium used was a solution of 62 g of GELATIN 01 and 5 mL of a halide-free solution of the anionic surfactant AN 02 in 1 L of distilled water instead of 4.1 g of AN 01 and 0.41 g of a halide-free solution of AN 02 in 750 mL of distilled water; and the silver nitrate solution concentration was 0.246M instead of 2.94M. 0.092 moles of sodium behenate and 0.123 moles of silver nitrate were utilized in the reaction. A fine and stable silver behenate dispersion was obtained, which did not flocculate out upon standing for 48 hours.

INVENTION EXAMPLE 18

In situ preparation of a silver behenate/silver halide-emulsion Silver behenate was prepared by dissolving 34 g (0.1 moles) of behenic acid in 340 mL of 2-propanol at 65° C., converting the behenic acid to sodium behenate by adding 400 mL of 0.25M aqueous sodium hydroxide to the stirred behenic acid solution and finally adding 250 mL of 0.4M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic surfactants AN 01 and AN 02 to produce a predispersion, which upon homogenization with a microfluidizer produced a finely divided and stable dispersion containing 20% by weight of silver behenate, 2.1% by weight of AN 01 and 0.203% by weight of AN 02. The pH of the resulting dispersion was adjusted to about 6.5. The silver behenate dispersion did not flocculate out upon standing for 48 hours.

The following ingredients were then added with stirring to 1.5 g of the silver behenate dispersion: 1 g of a 30% by weight concentration of BINDER 01, 0.013 g of succinimide, 0.1 g of a 11% by weight solution of saponin in a mixture of deionized water and methanol and 2.4 g of a 1.28% by weight aqueous solution of 3-(triphenylphosphonium)propionic acid bromide perbromide (PC01), corresponding to a concentration of 8 mol % of PC01 with respect to silver behenate, to accomplish in situ conversion of part of the silver behenate to silver bromide.

Transmission electron micrograph of the resulting silver behenate/silver bromide dispersion The transmission electron micrograph of the resulting dispersion produced at a magnification of 50,000× (1 cm=200 nm) is shown in FIG. 1. The large rod-shaped particles are silver behenate. The very small black particles, ≦40 nm in diameter, uniformly distributed over these silver behenate particles and also uniformly distributed between these particles are silver bromide particles.

Coating and drying and processing of the photothermographic material A subbed polyethylene terephthalate support having a thickness of 100 μm was doctor blade-coated with the silver behenate/silver bromide dispersion at a blade setting of 60 μm. After drying for several minutes at 40° C. on the coating bed, the emulsion layer was then doctor blade-coated with a 2.44% by weight aqueous solution of 3-(3,4-dihydroxyphenyl)propionic acid at a blade setting of 30 μm.

The resulting thermographic material was first allowed to dry on the coating bed for several minutes at 40° C. and then was dried for 1 hour in a hot air oven at 50° C.

Image-wise exposure and thermal development were carried out on the resulting photothermographic material as described for COMPARATIVE EXAMPLE 1 and very good images with a high contrast and good sharpness were obtained meriting a numerical score of 5.

Having described in detail preferred embodiments of the current invention, it will now be apparent to those skilled in the art that numerous modifications can be made therein without departing from the scope of the invention as defined in the following claims.

What is claimed is:

1. A photothermographic recording material comprising a support and a photo-addressable thermally developable element comprising photosensitive silver halide in catalytic association with a substantially light-insensitive organic silver salt, an organic reducing agent for said substantially light-insensitive organic silver salt in thermal working relationship therewith and a binder, wherein said substantially light-insensitive organic silver salt is a silver salt of an organic carboxylic acid, wherein either (1) said organic carboxylic acid consists of a carboxyl group and an organic moiety which organic moiety is selected from the group consisting of alkyl, aryl, aralkyl, and alkaryl, or (2) said organic carboxylic acid is an aliphatic carboxylic acid optionally substituted with a hydroxyl or thioether group; wherein said photo-addressable thermally developable element further comprises an anionic surfactant, said anionic surfactant being a sulfonate, and said binder is a polymer containing monomer units selected from the group consisting of a diene-monomer, a methacrylate, styrene and an acrylate.

2. Photothermographic recording material according to claim 1, wherein said anionic surfactant is a sulfonate.

3. The photothermographic recording material according to claim 1, wherein said sulfonate is an alkyl or alkaryl sulfonate.

4. Photothermographic recording material according to claim 1, wherein said polymer containing monomer units selected from the group consisting of a diene-monomer, a methacrylate, styrene and an acrylate is a polymer latex.

5. Photothermographic recording material according to claim 1, wherein said photo-addressable thermally developable element is provided with a protective layer.

6. Photothermographic recording material according to claim 1, wherein said photo-addressable thermally developable element further comprises a dye with maximum absorbance in the wavelength range 600 to 1100 nm.

7. The recording material according to claim 1, wherein said photo-addressable thermally developable element further comprises a non-ionic surfactant.

8. Photothermographic recording material according to claim 7, wherein said non-ionic surfactant is an alkoxy-polyethoxy-ethanol or an alkaryloxy-polyethoxy-ethanol.

9. The recording material according to claim 1, wherein the anionic surfactant is selected from the group consisting of sodium dodecylbenzene sulfonate, sodium salt of bis-(2'-ethylhexyl)ester of sulfosuccinic acid, sodium β-(methyl-oleyl-amino)ethylsulfonate, sodium 2,4,6-tributylphenoxy polyethoxy sulfonate, sodium salt of 4,7-dibutyl-2-sulfonaphthalene, sodium salt of 4,7-bis(isobutyl)-2-naphthalenesulfonic acid and sodium salt of tris(isopropyl) naphthalenesulfonic acid.

10. A process for producing a photothermographic recording material, including a support and a photo-addressable thermally developable element containing photosensitive silver halide in catalytic association with a substantially light-insensitive organic silver salt of an organic carboxylic acid, an organic reducing agent for said substantially light-insensitive organic silver salt in thermal working relationship therewith and a binder, comprising the steps of: (i) preparing an aqueous suspension of particles of a substantially light-insensitive silver salt of an organic carboxylic acid, wherein either (1) said organic carboxylic acid consists of a carboxyl group and an organic moiety which organic moiety is selected from the group consisting of alkyl, aryl, aralkyl, and alkaryl, or (2) said organic carboxylic acid is an aliphatic carboxylic acid optionally substituted with a hydroxyl or thioether group; (ii) preparing an aqueous dispersion or aqueous dispersions containing said photosensitive silver halide, said particles of a substantially light-insensitive organic silver salt, said organic reducing agent, and said binder (iii) coating said aqueous dispersion or aqueous dispersions onto a support, wherein said photo-addressable thermally developable element further comprises an anionic surfactant anionic anionic surfactant being a sulfonate, and said binder is a polymer containing monomer units selected from the group consisting of a diene-monomer, a methacrylate, styrene and an acrylate.

11. A process according to claim 10, wherein said suspension of particles of a substantially light-insensitive silver salt of an organic carboxylic acid is produced by simultaneous metered addition of an aqueous solution or suspension of an organic carboxylic acid, or its salt, and an aqueous solution of a silver salt to an aqueous liquid and said metered addition of said aqueous solution or suspension of said organic carboxylic acid or its salt; and/or said aqueous solution of said silver salt is regulated by the concentration of silver ions or the concentration of anions of said silver salt in said aqueous liquid.

12. A process for producing a photothermographic recording material according to claim 10, wherein said process further comprises the step of preparing particles of said photosensitive silver halide from excess silver ions associated with particles of said substantially light-insensitive silver salt of an organic carboxylic acid.

13. The process according to claim 10, wherein said photo-addressable thermally developable element further comprises a non-ionic surfactant.

14. The process according to claim 8, wherein the anionic surfactant is selected from the group consisting of sodium dodecylbenzene sulfonate, sodium salt of bis-(2'-ethylhexyl) ester of sulfosuccinic acid, sodium β-(methyl-oleyl-amino) ethylsulfonate, sodium 2,4,6-tributylphenoxy polyethoxy sulfonate, sodium salt of 4,7-dibutyl-2-sulfonaphthalene, sodium salt of 4,7-bis(isobutyl)-2-naphthalenesulfonic acid and sodium salt of tris(isopropyl)naphthalenesulfonic acid.

15. A photothermographic recording process comprising the steps of: (i) image-wise exposing a photothermographic recording material, including a support and a photo-addressable thermally developable element containing photosensitive silver halide in catalytic association with a substantially light-insensitive organic silver salt, an organic reducing agent for said substantially light-insensitive organic silver salt in thermal working relationship therewith and a binder to a source of actinic radiation to which said photothermographic recording material is sensitive, and (ii) thermally developing said image-wise exposed photothermographic recording material, wherein said substantially light-insensitive organic silver salt is a silver salt of an organic carboxylic acid, wherein either (1) said organic carboxylic acid consists of a carboxyl group and an organic moiety which organic moiety is selected from the group consisting of alkyl, aryl, aralkyl, and alkaryl, or (2) said organic carboxylic acid is an aliphatic carboxylic acid optionally substituted with a hydroxyl or thioether group; wherein said photo-addressable thermally developable element further contains an anionic surfactant said anionic surfactant being a sulfonate, and said binder is a polymer containing monomer units selected from the group consisting of a diene-monomer, a methacrylate, styrene and an acrylate.

16. The process according to claim 15, wherein said photo-addressable thermally developable element further comprises a non-ionic surfactant.

17. The process according to claim 15, wherein the anionic surfactant is selected from the group consisting of sodium dodecylbenzene sulfonate, sodium salt of bis-(2'-ethylhexyl) ester of sulfosuccinic acid, sodium β-(methyl-oleyl-amino)ethylsulfonate, sodium 2,4,6-tributylphenoxy polyethoxy sulfonate, sodium salt of 4,7-dibutyl-2-sulfonaphthalene, sodium salt of 4,7-bis(isobutyl)-2-naphthalenesulfonic acid and sodium salt of tris(isopropyl) naphthalenesulfonic acid.

18. A photothermographic recording material comprising a support and a photo-addressable thermally developable element comprising (i) a photosensitive silver halide, (ii) silver behenate in catalytic association with the photosensitive silver halide, (iii) an organic reducing agent for said silver behenate in thermal working relationship therewith, (iv) a sodium salt of bis-(2'-ethylhexyl) ester of sulfosuccinic acid, and (v) a binder, wherein said binder is a polymer containing monomer units selected from the group consisting of a diene-monomer, a methacrylate, styrene and an acrylate.

* * * * *

UNITED STATES PATENT AND TRADEMARK OFFICE

CERTIFICATE OF CORRECTION

PATENT NO. : 6,187,528 B1
DATED : February 13, 2001
INVENTOR(S) : Uytterhoeven et al.

It is certified that error appears in the above-identified patent and that said Letters Patent is hereby corrected as shown below:

Column 23,
Line 67, "surfactant anionic" should read -- surfactant, said --

Column 24,
Line 23, "claim 8," should read -- claim 10, --

Signed and Sealed this

Twentieth Day of November, 2001

*Attest:*

Nicholas P. Godici

NICHOLAS P. GODICI
*Acting Director of the United States Patent and Trademark Office*

*Attesting Officer*